United States Patent [19]

Haeussler

[11] 4,173,367

[45] Nov. 6, 1979

[54] PICKUP UNIT FOR LIFTING CONCRETE BODY

[76] Inventor: Ernest Haeussler, Grashofstraesse 47, 4300 Essen-Bredeney, Fed. Rep. of Germany

[21] Appl. No.: 882,249

[22] Filed: Feb. 28, 1978

[30] Foreign Application Priority Data

Mar. 1, 1977 [DE] Fed. Rep. of Germany ..... 2708787
Mar. 1, 1977 [DE] Fed. Rep. of Germany ..... 2708788

[51] Int. Cl.[2] ..... B66C 1/36; B66C 1/66

[52] U.S. Cl. ..... 294/83 R; 294/89; 294/90

[58] Field of Search ..... 294/78 R, 83 R, 84, 294/89, 90; 24/230.5 R, 232, 241 SL; 52/125, 698, 699, 700

[56] References Cited

U.S. PATENT DOCUMENTS

| | | | |
|---|---|---|---|
| 958,978 | 5/1910 | Spencer | 294/83 R |
| 2,184,812 | 12/1939 | Hendrix | 294/78 R X |
| 2,523,434 | 9/1950 | Johnson | 294/83 R |
| 3,499,676 | 3/1970 | Haeussler | 294/90 |

FOREIGN PATENT DOCUMENTS

| | | | |
|---|---|---|---|
| 1756606 | 4/1970 | Fed. Rep. of Germany | 294/89 |
| 1808988 | 6/1970 | Fed. Rep. of Germany | 294/89 |

*Primary Examiner*—Johnny D. Cherry
*Attorney, Agent, or Firm*—Karl F. Ross

[57] ABSTRACT

A pickup bolt is embedded in a concrete body with its head spaced from the surface of this body. A pickup member is pivotal on a shackle hung from a crane cable or the like and has a generally radially extending actuation arm and an angularly elongated and outwardly open pickup slot lying generally in a plane perpendicular to the pivot axis. This slot has a relatively wide end permitting radial passage of the bolt head into and out of the interior of the pickup member and an angularly opposite relatively narrow end which is insufficiently wide to permit passage of the head out of the body. Thus the pickup member can be positioned over the head with its wide end and then swung angularly through a distance equal to the length of the slot to lock this pickup member on the bolt. A secantally displaceable locking bolt may be provided in the pickup member to prevent passage of the head of the pickup bolt along the passage toward the wide end.

13 Claims, 12 Drawing Figures

VII
VII
18
7'
6'
11
13'
8'
12'
5
17
4'
15
16
9'
23
4
3
10'
24
8'
10'
6'

PICKUP UNIT FOR LIFTING CONCRETE BODY

Field of the Invention

The present invention relates to a pickup unit. More particularly this invention concerns a pickup unit normally connected to the hook of the crane or the like and adapted to lift a body of concrete or the like in which is embedded a bolt whose head extends beyond a surface of the body.

BACKGROUND OF THE INVENTION

In the construction of the buildings and the like from prefabricated concrete bodies constituted as blocks, panels or the like, it is standard practice to embed in such bodies so-called pickup bolts whose shafts are embedded in the body and extend slightly therefrom and which have heads on the ends of the shafts that are engaged by special pickup units for lifting of the body. In order to facilitate shipping of such a concrete body it is standard practice to recess the head of the bolt somewhat by forming the surface of the body at the bolt with an outwardly concave seat.

The standard pickup unit is a one-piece device formed as a so-called spoon, that is having a hollow head formed with an angularly extending slot one end of which is widened for fitting-in of the bolt head. This body has a radially extending arm that normally projects away from the head adjacent the wide end of the slot and lying in the plane of the slot. The free end of this arm is connected to the lift or hoist cable that in turn extends up to the boom of the crane.

In use such a device must be manhandled into position over the bolt to which it has to be connected, with sufficient slack in the lifting cable or rope to allow the arm to be laid practically flat down on the body to be lifted so that the wide end of the slot can be positioned over the bolt. After such positioning the entire assembly, including the length of cable connected to it, must be swung through a substantial angle to ensure that the bolt head is positioned well in the slot. Once the lift is done, the device must be pivoted back down to align the bolt with the wide end of the slot and then lifted off by hand.

Such an arrangement has several considerable disadvantages. First of all the necessity of positioning the entire unit by hand, including placing it over the bolt and removing it from over the bolt after the lift is completed, is extremely laborious. What is more the real danger exists in such a system that the arm will fall back to the position with the wide end of the slot over the bolt so that when the lift is attempted the pickup unit will merely be pulled off the body of concrete and will have to be repositioned. Finally it is impossible to actuate such a device from afar, even a relatively skillful crane operator can rarely succeed intentionally in lifting such a pickup unit off the body after a lift is completed.

OBJECTS OF THE INVENTION

It is therefore an object of the present invention to provide an improved pickup unit of the above-described general type.

Another object is to provide such a unit which can be positioned and removed with relative ease and with a mininum of heavy manual labor.

Yet another object is to provide such a pickup unit which can be operated in a simple manner from afar.

Yet a further object of this invention is the provision of a pickup unit of the above-described general type which is extremely safe in operation so that it is almost impossible accidentally to disattach it from the body being lifted.

SUMMARY OF THE INVENTION

These objects are attained in accordance with the present invention in a pickup unit wherein the pickup member is pivotal on a shackle about a pickup axis that is generally perpendicular to the plane of the slot that receives the head of the bolt on the object to be picked up. This shackle is in turn adapted to be connected to the hoist cable, chain, hook, or the like. Thus in use the pickup member may be lowered into the approximate position of the bolt to which it is to be connected and a worker need merely push it into the appropriate position and swing the actuation arm of the pickup member through an arc sufficient to bring the shaft of the bolt from the one end of the angularly extending slot to the other end thereof. At this other end the slot is internally sufficiently wide to accommodate the head and externally wide enough to permit the shaft to extend out of the slot, but not wide enough to permit the head to pass angularly out of the slot. The relatively heavy actuation member therefore can remain suspended from the shackle during the operations of fitting it to the bolt or freeing it therefrom, so that the user of the device need not him- or herself have to manhandle the unit into place.

Another considerable advantage of the instant invention is that it is possible to secure an operating or trip line to the radially extending arm of the pickup member so that the unit can be actuated from afar. This arrangement is particularly useful in a system wherein the slot has an angular width of between 160° and 200°, preferably about 180°, and wherein the arm can swing through the shackle which is preferably formed as an elongated eye. Thus once the lift has been completed the crane operator need merely let off tension in the lift line to a limited extent and then exert a sharp jerk on the trip line to swing the actuation member through 180°, whereupon the entire unit can be picked up off the block that was just lifted, without the necessity of a worker having to climb up onto the block and disengage the pickup unit.

According to yet another feature of this invention the pickup member is formed with a secantally extending guide that opens into the slot adjacent the wide end thereof. A locking finger or bolt is provided in this guide which can move therein between a locking position extending across the slot and blocking displacement of the bolt along the guide and a freeing position allowing such displacement. A branch of the above-mentioned pickup line, preferably provided with an elastic insert, is connected to the outer end of this bolt so that the bolt can be withdrawn and the pickup member can be pivoted into a position with the wide end of its slot directed straight downwardly for freeing of the pickup member from the pickup bolt.

According to yet another feature of the instant invention the pivot axis lies slightly above the center of curvature of the slot. Furthermore the pickup member is so constituted that its center of gravity lies below the pivot axis, in such a manner that it will inherently assume a position with the pickup bolt in one end or the other of its slot.

SPECIFIC DESCRIPTION

Figure 1:
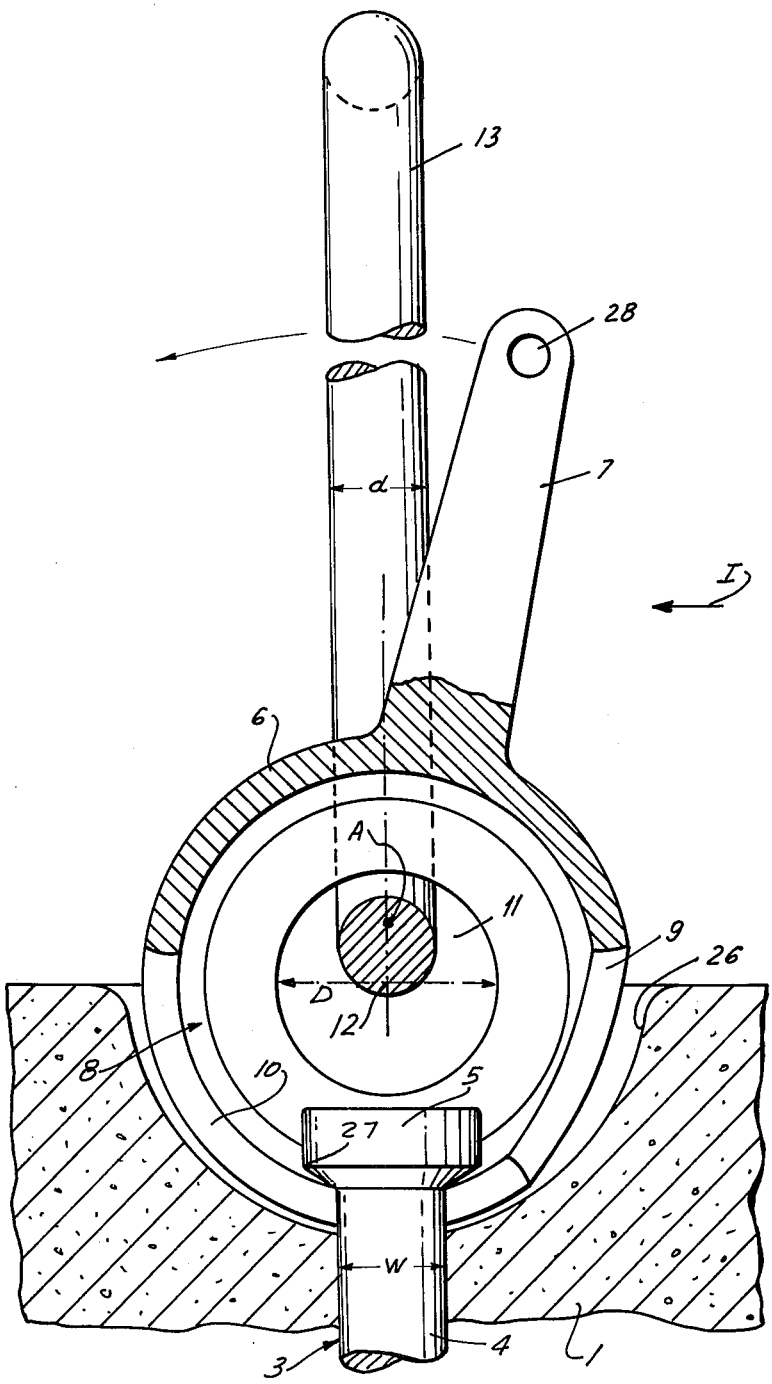
FIG. 1 is a side-sectional view of a pickup unit according to the instant invention.
Figure 2:
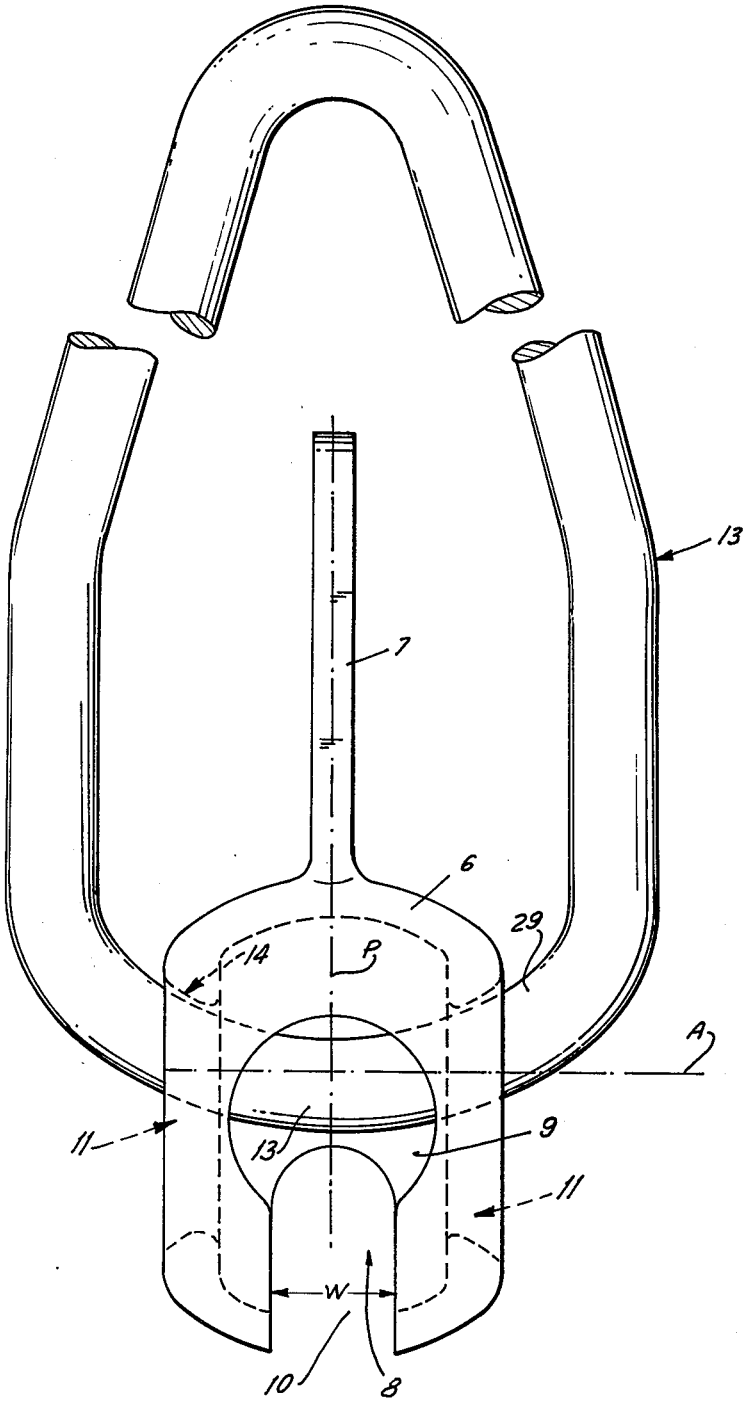
FIG. 2 is a view taken in the direction of arrow II of FIG. 1.
Figure 5:
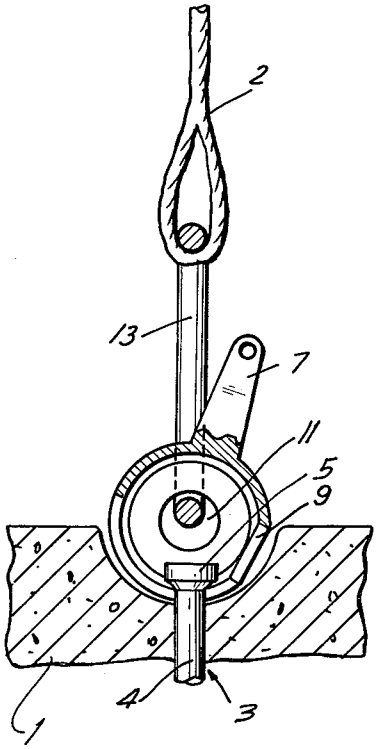
FIGS. 3, 4, and 5 show the pickup unit of FIG. 1 in various positions of use.
Figure 4:
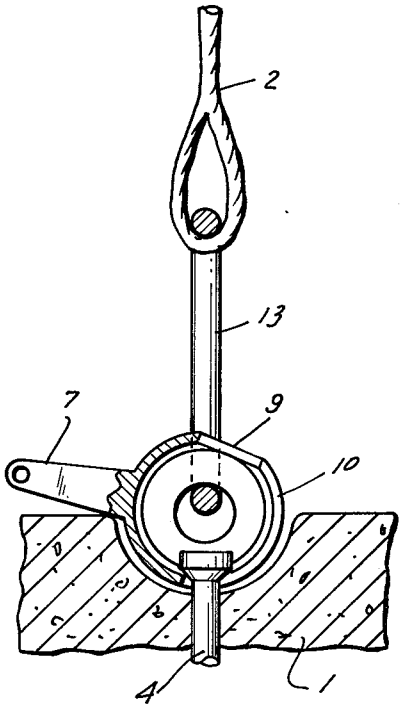

As shown in FIGS. 1–5 a body 1 of concrete is formed with a semispherical seat 26 into which extends a bolt 3 having a shank or shaft 4 embedded in the body 1 and a head 5 wholly recessed within the seat 26 and connected via a frustoconical neck 27 to the shaft 4. A cable 2 extending up to the boom of a crane supports a spoon-type pickup member 6 by means of a shackle 13.

The pickup member 6 is formed unitarily of steel and has a radially extending arm 7 formed at its free end and with a throughgoing hole 28 adapted to be connected to a trip line as will be described herein below. The body of the pickup member 6 has a hollow interior 8 which opens via a slot 10 having a width W slightly greater than the diameter w of the shaft 4. This slot 10 extends radially through an arc of approximately 180° and has at one end an enlargement 9 of generally circular outline and a slightly greater diameter than that of the head 5 of the bolt 3.

In addition the body 1 is formed to either side of the plane P of the slot 10 with a circular throughgoing hole 11 having a diameter D which is substantially greater than the diameter d of the heavy steel rod forming the shackle. The edges of the hole 11 are flared as shown at 14 so that they lie on the part-circular lower portion 29 of the shackle 13 in line contact to both sides of the slot 10. Thus the entire member 6 can rotate on the shackle 13 about an axis A which lies slightly above the center of curvature 12 of the slot 10. This center of curvature 12 also corresponds to the center of gravity of the body 6, not taking into account the arm 7.

Figure 3:
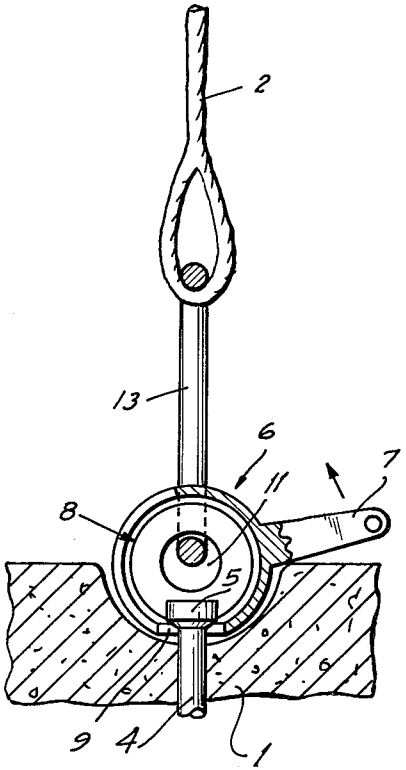

In use as shown in FIG. 3 the device is lowered by means of the cable 2 into a position in which the enlarged end 9 of the slot 10 can be dropped over the head 5 of the bolt 3. Thereafter the user need merely pivot the device by means of the arm 7 or a trip line connected thereto from the position of FIG. 3 through the position of FIG. 5 into the position of FIG. 4. During such pivoting the arm 7 swings through the shackle 13. Thereafter it is possible to lift the block 1 in complete security, as the bolt head 5 cannot pass out of the interior 8 of the body 6 through the slot 10 and since the weight of the pivot member 6 lies wholly below the pivot axis A with the arm 7 extending to one side further to ensure that the position of the member 6 will not change. After the lift it is possible by simple reverse pivoting from the position of FIG. 4 to the position of FIG. 3 to free the device whereupon it can be lifted up by means of the cable 2.

The arrangement of FIGS. 6–10 is similar to that of FIGS. 1–5, with common reference numerals being applied to functionally identical structure. Here, however, the pickup member 6′ has two parallel arms 7′ that are welded onto a substantially solid spherical body constituting the member 6′. This member 6′ is formed with a single diametrically throughgoing passage 11′ having an upper surface 14′ of the same radius of curvature as the lower portion 29′ of the shackle 13′.

In addition this pickup member 6′ has an interior passage or cavity 8′ sufficiently large to receive the head of the bolt and opening via a slot 10′ having a wide end 9′ much as described above with relation to FIGS. 1–5, but here with an arcuate slot length equal to approximately 90° rather than 180°. Once again the center of curvature 12′ of the slot 10′ lies below the pivot axis A′ of the pickup member 6′.

Figures 6, 6A:
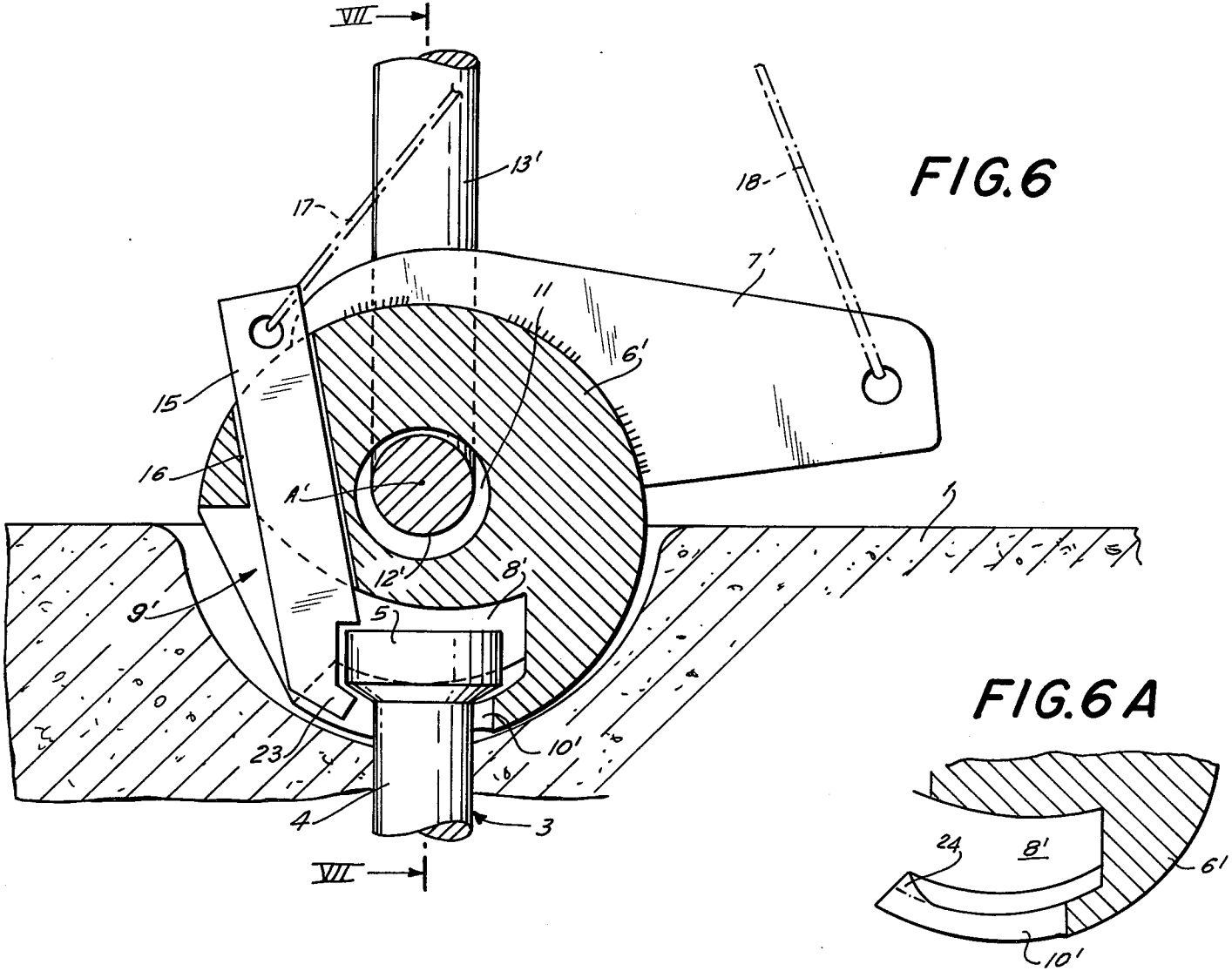
FIG. 6 is a view similar to FIG. 1 showing another pickup unit according to this invention.
FIG. 6A is a view of a detail of FIG. 6.
Figure 7:
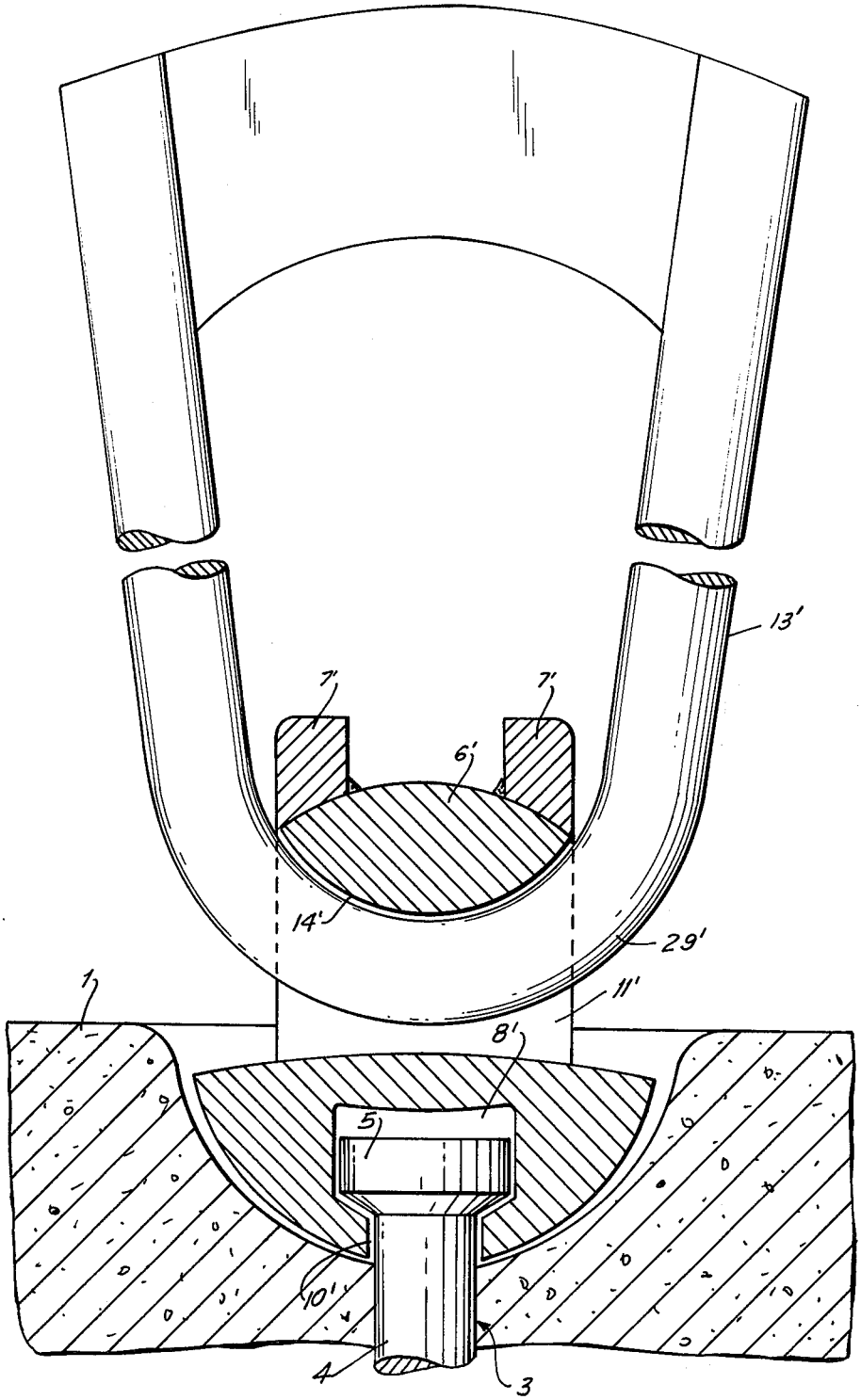
FIG. 7 is a section taken along line VII—VII of FIG. 6.

Furthermore the pickup member 6′ is formed with a secantally extending guide passage 16 that opens into the slot 10′ adjacent to the wide end 9′ thereof and that lies generally in a plane perpendicular to the axis A′. A locking bolt 15 is secantally displaceable in this guide passage 16 from a position with a tooth 23 at its lower end engaging under the head 5 of the bolt 3 to a position wholly outside the slot (see FIGS. 9 and 10). In addition the slot 10′ is formed adjacent the wide end portion 9′ with a pair of inwardly projecting bosses 24 as shown in FIG. 6A.

A main relatively inextensible trip line is connected to the free ends of the arms 7′ and a branch trip line 17 either of elastic material or provided with a spring as shown at 25 connects this main trip line 18 to the locking bolt 15.

Figure 10:
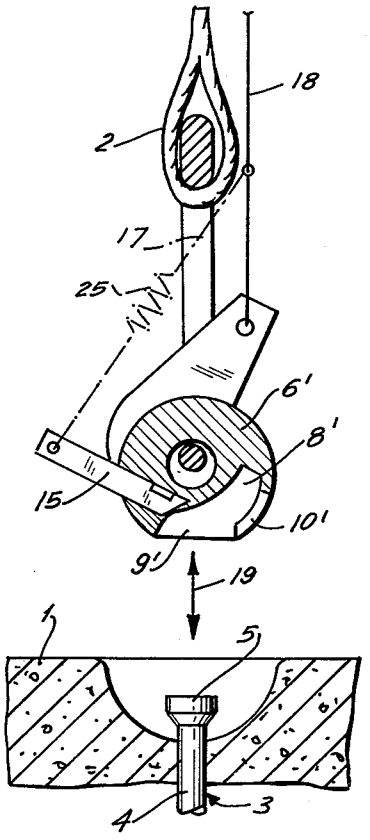
FIGS. 8–10 are side views showing the pickup unit of FIG. 6 in various operational positions.
Figure 9:
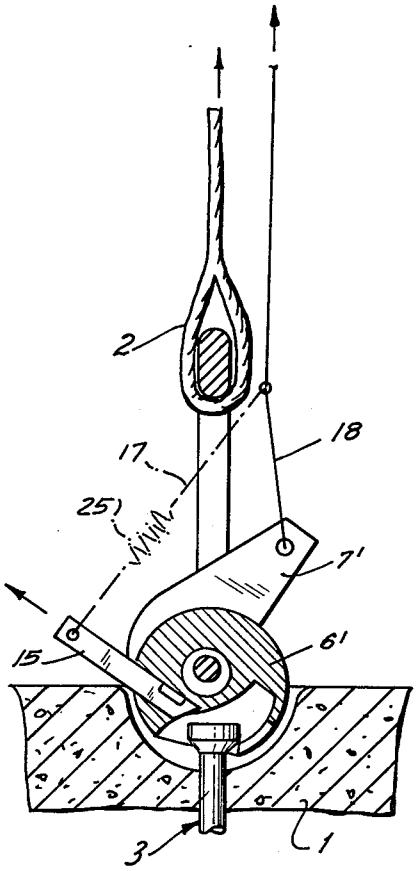
Figure 8:
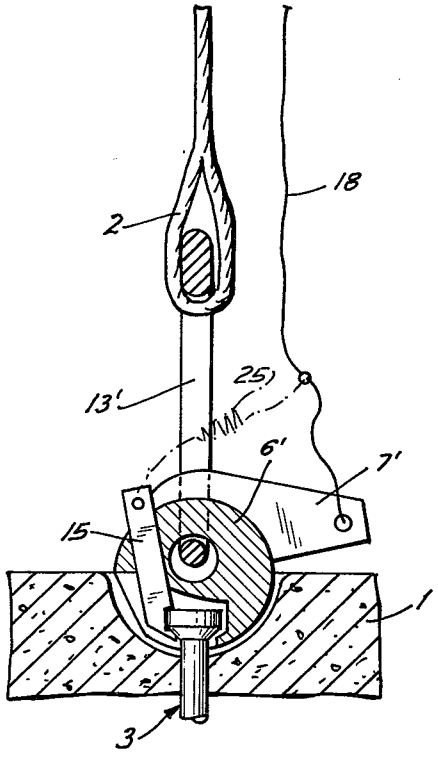

With this structure shown in FIGS. 8–10 once the device is positioned over the bolt 3 as shown in FIG. 8 the blocking bolt 15 effectively prevents pivoting of the pickup member 6′ in a direction that would move the bolt 5 toward the widened end 9′. For freeing of the unit as shown in FIG. 9 a pull is exerted on the main trip line 18 which first of all pulls the bolt 15 out of the interior 8′ of the member 6′ and then pivots the member 6′ about the axis A′. During such pivoting it is necessary that there will be no stress in the cable 2, as the bosses 24 will prevent sliding of the bolt head out of the wide end 9′. FIG. 10 shows how once the trip line 18 is stressed it is possible to raise or lower the entire unit as shown by the double-headed arrow 19 onto or off the bolt 5.

Figure 11:
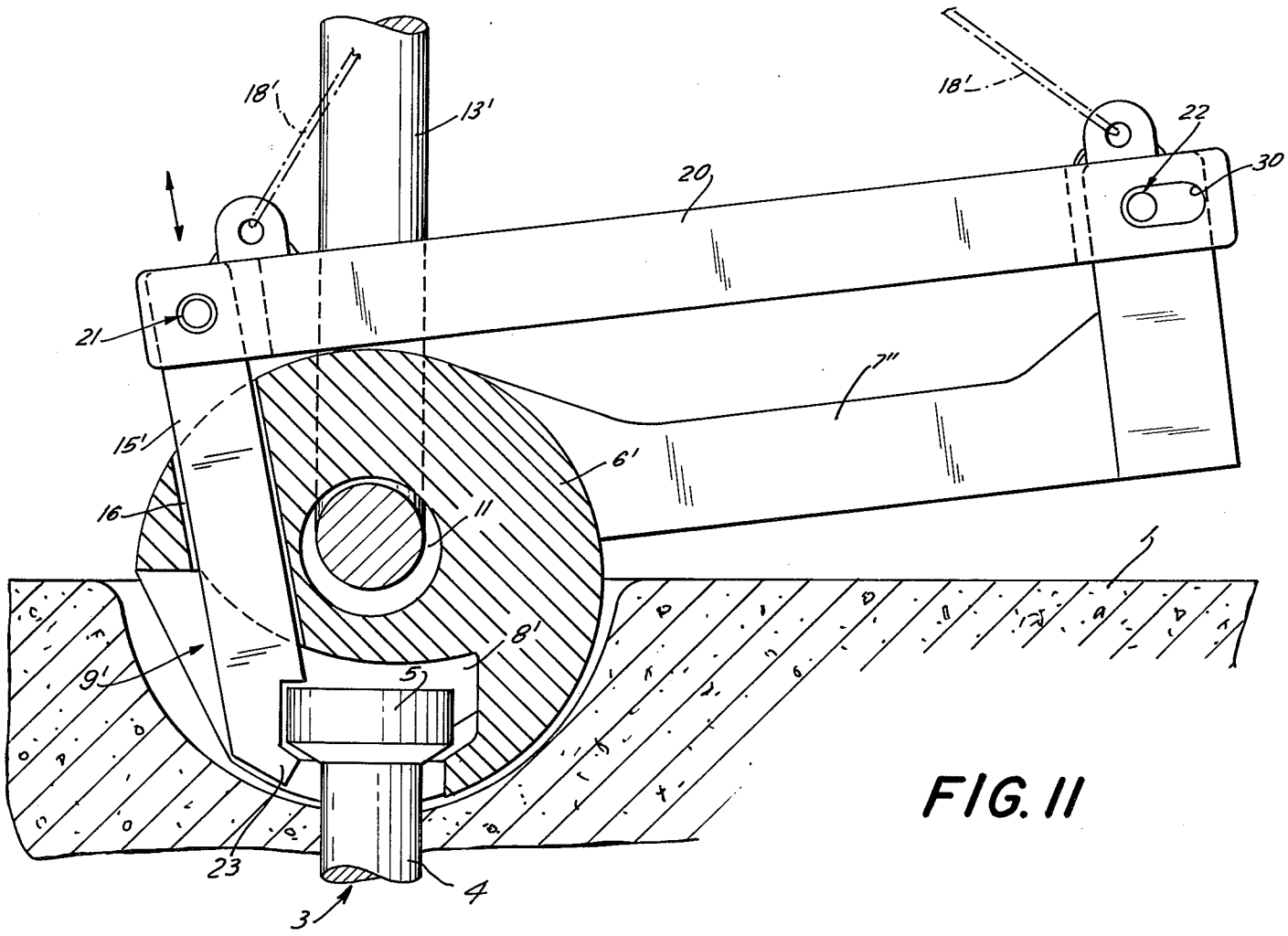
FIG. 11 is a view similar to FIG. 6 showing a variation on the pickup unit of FIG. 6.

FIG. 11 shows an alternate arrangement wherein a link 20 is pivoted at 21 on the upper end of the bolt 15′ identical to the bolt 15 and at the other end via a slot 30 on a pivot pin 22 carried on the free ends of the arms 7″ otherwise functionally identical to the arms 7′. A double trip line 18′ is usable in this arrangement to first pull the bolt 15′ out of the guide 16 and thereafter to pivot up the arms 7″ for freeing of the pickup member 6′ from the bolt 3. Either or both of the pivot pins 21 and 22 could be made removable to prevent accidental actuation of the device, or similarly a locking pin could pass through the body 6′ and bolt 15′ to prevent any inadvertent actuation of this bolt 15′.

With the system according to the instant invention it is therefore not necessary for the user of the device him- or herself to have to lift the pickup unit onto or off of the bolt head. Instead the shackle 13 or 13′ can support the pickup unit and the user need merely pivot the member 6 or 6′ into the necessary position. What is more the instant invention allows remote actuation of the device so as further to reduced the amount of manual labor necessary for operation of the pickup unit.

I claim:

1. A pickup unit for lifting a body from which projects a bolt having a relatively narrow shaft embedded in and projecting from said body and a relatively wide head on said shaft spaced from said body, said unit comprising:

a shackle; and a pickup member pivotal on said shackle about a pickup axis and having a generally radially extending actuation arm and an angularly elongated and outwardly open pickup slot lying generally in a plane perpendicular to said axis and having a relatively wide end permitting radial passage of said head into and out of said slot and an angularly opposite relatively narrow end internally sufficiently wide to accommodate said head but externally insufficiently wide to permit radial passage of said head out of said slot, said slot being substantially centered on said axis and internally sufficiently wide between said ends to permit said head to pass angularly along said slot between said ends with said shaft extending out of said slot, whereby said member can pivot about said axis with said bolt engaged in said slot without displacement of said shackle relative to said bolt.

2. The unit defined in claim 1 wherein said pickup member is formed with a throughgoing passage at said axis, said shackle having a portion extending through said member at said passage and defining said axis.

3. The unit defined in claim 2 wherein said portion fits with radial play in said passage and said slot is arcuate and has a center of curvature lying below said portion when said member is suspended from said shackle.

4. The unit defined in claim 2 wherein said slot has an arc length of between 160° and 200° and in a position with either of its said ends directed downwardly said arm is directed generally horizontally.

5. The unit defined in claim 2 wherein said unit is generally ball-shaped and hollow.

6. The unit defined in claim 2, further comprising a locking bolt displaceable in said member between a locking position extending at least partially into said slot and preventing displacement of said head along said slot past said locking bolt and a freeing position substantially out of said slot and permitting displacement of said head along said slot.

7. The unit defined in claim 6 wherein said member is formed with a guide extending generally in said plane secantally of said slot adjacent said wide end thereof, said locking bolt being secantally displaceable in said guide.

8. The unit defined in claim 7, further comprising a trip line connected to said locking bolt for displacing same into said freeing position from said locking position.

9. The unit defined in claim 8 wherein said line is connected to said arm and has an at least partially elastic branch connected to said locking bolt.

10. The unit defined in claim 7 wherein said locking bolt is formed with a tooth engaging under said head in said locking position and said slot is formed adjacent said wide end with a radially inwardly projecting boss.

11. A pickup unit for lifting a body from which projects a bolt having a relatively narrow shaft embedded in and projecting from said body and a relatively wide head on said shaft spaced from said body, said unit comprising:

a shackle;

a pickup member pivotal on said shackle about a pickup axis and having a generally radially extending actuation arm and an angularly elongated and outwardly open pickup slot lying generally in a plane perpendicular to said axis and having a relatively wide end permitting radial passage of said head into and out of said slot and an angularly opposite relatively narrow end internally sufficiently wide to accommodate said head but externally insufficiently wide to permit radial passage of said head out of said slot, said slot being internally sufficiently wide between said ends to permit said head to pass angularly along said slot between said ends with said shaft extending out of said slot;

a locking bolt displaceable in said member between a locking position extending at least partially into said slot and preventing displacement of said head along said slot past said bolt and a freeing position substantially out of said slot and permitting displacement of said head along said slot; and a trip line connected to said arm and having an at least partially elastic branch connected to said locking bolt for displacing same into said freeing position from said locking position.

12. A pickup unit for lifting a body from which projects a bolt having a relatively narrow shaft embedded in and projecting from said body and a relatively wide head on said shaft spaced from said body, said unit comprising:

a shackle;

a pickup member pivotal on said shackle about a pickup axis and having a generally radially extending actuation arm and an angularly elongated and outwardly open pickup slot lying generally in a plane perpendicular to said axis and having a relatively wide end permitting radial passage of said head into and out of said slot and an angularly opposite relatively narrow end internally sufficiently wide to accommodate said head but externally insufficiently wide to permit radial passage of said head out of said slot, said slot being internally sufficiently wide between said ends to permit said head to pass angularly along said slot between said ends with said shaft extending out of said slot; and a locking bolt displaceable in said member between a locking position extending at least partially into said slot and preventing displacement of said head along said slot past said locking bolt and a freeing position substantially out of said slot and permitting displacement of said head along said slot, said locking bolt being formed with a tooth engaging under said head in said locking position.

13. A pickup unit for lifting a body from which projects a bolt having a relatively narrow shaft embedded in and projecting from said body and a relatively wide head on said shaft spaced from said body, said unit comprising:

a shackle; and a pickup member pivotal on said shackle about a pickup axis and having a generally radially extending actuation arm and an angularly elongated and outwardly open pickup slot lying generally in a plane perpendicular to said axis and having a relatively wide end permitting radial passage of said head into and out of said slot and an angularly opposite relatively narrow end internally sufficiently wide to accommodate said head but externally insufficiently wide to permit radial passage of said head out of said slot, said slot being internally sufficiently wide between said ends to permit said head to pass angularly along said slot between said ends with said shaft extending out of said slot, said slot being formed adjacent said wide end with a radially inwardly projecting boss.

* * * * *